US010720690B2

(12) United States Patent
Shiue

(10) Patent No.: US 10,720,690 B2
(45) Date of Patent: Jul. 21, 2020

(54) TRANSMISSION LINE STRUCTURE HAVING FIRST AND SECOND SEGMENTED TRANSMISSION LINES WITH EXTENDING SEGMENTS LOCATED THEREIN

(71) Applicant: Chung Yuan Christian University, Taoyuan (TW)

(72) Inventor: Guang-Hwa Shiue, Taoyuan (TW)

(73) Assignee: CHUNG YUAN CHRISTIAN UNIVERSITY, Taoyuan (TW)

( * ) Notice: Subject to any disclaimer, the term of this patent is extended or adjusted under 35 U.S.C. 154(b) by 42 days.

(21) Appl. No.: 16/170,561

(22) Filed: Oct. 25, 2018

(65) Prior Publication Data

US 2020/0067163 A1 Feb. 27, 2020

(30) Foreign Application Priority Data

Aug. 24, 2018 (TW) ..... 107129613 A

(51) Int. Cl.
*H01P 9/00* (2006.01)
*H01P 3/08* (2006.01)

(52) U.S. Cl.
CPC ..... *H01P 9/006* (2013.01); *H01P 3/081* (2013.01)

(58) Field of Classification Search
CPC .. H01P 9/006; H01P 9/00; H01P 3/081; H01P 3/085; H01P 3/088
USPC ..... 333/161, 238, 1
See application file for complete search history.

(56) References Cited

U.S. PATENT DOCUMENTS 9,570,784 B2 * 2/2017 Baba et al. ..... H01P 1/20345
2012/0112857 A1 * 5/2012 Lim et al. ..... H01P 1/2039 333/238
2016/0126607 A1 * 5/2016 Leipold et al. ..... H01P 1/20381 333/161

* cited by examiner

*Primary Examiner* — Benny T Lee
(74) *Attorney, Agent, or Firm* — Locke Lord LLP; Tim Tingkang Xia, Esq.

(57) ABSTRACT

A transmission line structure includes a first transmission line having a first and a second extending line segments and a first and a second line segments extending along a first direction and a third line segment extending along a second direction, and a second transmission line having a third and a fourth extending line segments, a fourth and a fifth line segments extending along the first direction and a sixth line segment extending along the second direction. The first and the second extending line segment are connected to ends of the first and the second line segment. The third line segment is connected to sides of the first and the second line segment. The third and the fourth extending line segment are connected to ends of the fourth the fifth line segment. The sixth line segment is connected to sides of the fourth and the fifth line segment.

8 Claims, 7 Drawing Sheets

TRANSMISSION LINE STRUCTURE HAVING FIRST AND SECOND SEGMENTED TRANSMISSION LINES WITH EXTENDING SEGMENTS LOCATED THEREIN

CROSS-REFERENCE TO RELATED APPLICATIONS

This non-provisional application claims priority under 35 U.S.C. § 119(a) on Patent Application No(s). 107129613 filed in Taiwan, R.O.C. on Aug. 24, 2018, the entire contents of which are hereby incorporated by reference.

TECHNICAL FIELD

The disclosure relates to a transmission line structure, more particularly to a serpentine transmission line structure.

BACKGROUND

Recently, with the trend of high speed digitalized communication, high frequency electrical products, computer hardware and software adapted for high speed signals and integrated circuits have developed rapidly. Therefore, the demands for operation frequencies and frequency bands of signals are increasing. Moreover, the increase in the transmission speed of signals and the miniaturization of interconnected products such as connectors, cables or printed circuit boards have resulted in the increased layout densities of circuits. As a result, problems regarding signal transmissions arise, such as signal integrity, electromagnetic interference, electromagnetic compatibility or power integrity.

SUMMARY OF THE INVENTION

A transmission line structure includes a first transmission line and a second transmission line parallel to each other. The first transmission line includes a first extending segment, a first line segment, a second extending segment, a second line segment and a third line segment. The first extending segment extends in a first direction. The first line segment extends in the first direction, with an end of the first line segment electrically connected to the first extending segment. The second extending segment extends in the first direction. The second line segment extends in the first direction, with an end of the second line segment electrically connected to the second extending segment. The third line segment extends in a second direction perpendicular to the first direction and electrically connected to a side of the first line segment and a side of the second line segment. The second transmission line includes a third extending segment, a fourth line segment, a fourth extending segment, a fifth line segment and a sixth line segment. The third extending segment extends in the first direction. The fourth line segment extends in the first direction, with an end of the fourth line segment electrically connected to the third extending segment. The fourth extending segment extends in the first direction. The fifth line segment extends in the first direction, with an end of the fifth line segment electrically connected to the fourth extending segment. The sixth line segment extends in the second direction and electrically connected to a side of the fourth line segment and a side of the fifth line segment. The third line segment is aligned with the sixth line segment in the second direction, the end of the first line segment is adjacent to the side of the first line segment, the end of the second line segment is adjacent to the side of the second line segment, the end of the fourth line segment is adjacent to the side of the fourth line segment, and the end of the fifth line segment is adjacent to the side of the fifth line segment.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION OF THE INVENTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1A:
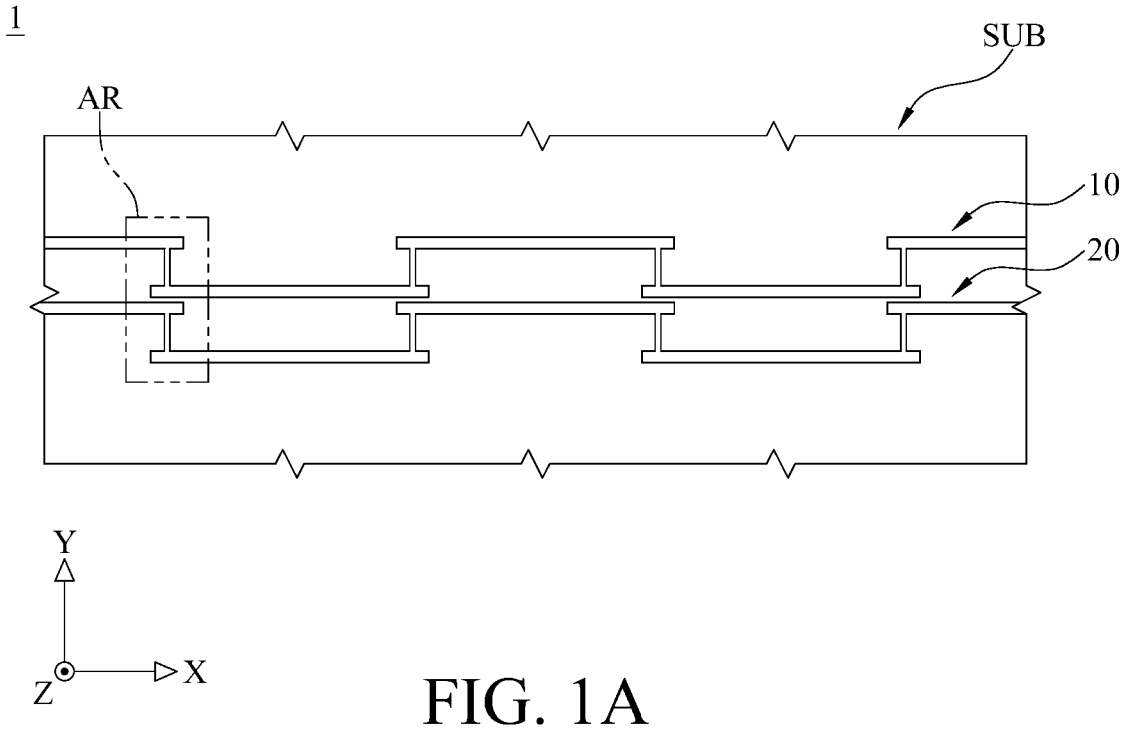
FIG. 1A is a top view of a transmission line structure according to one embodiment of the present disclosure.
Figure 1B:
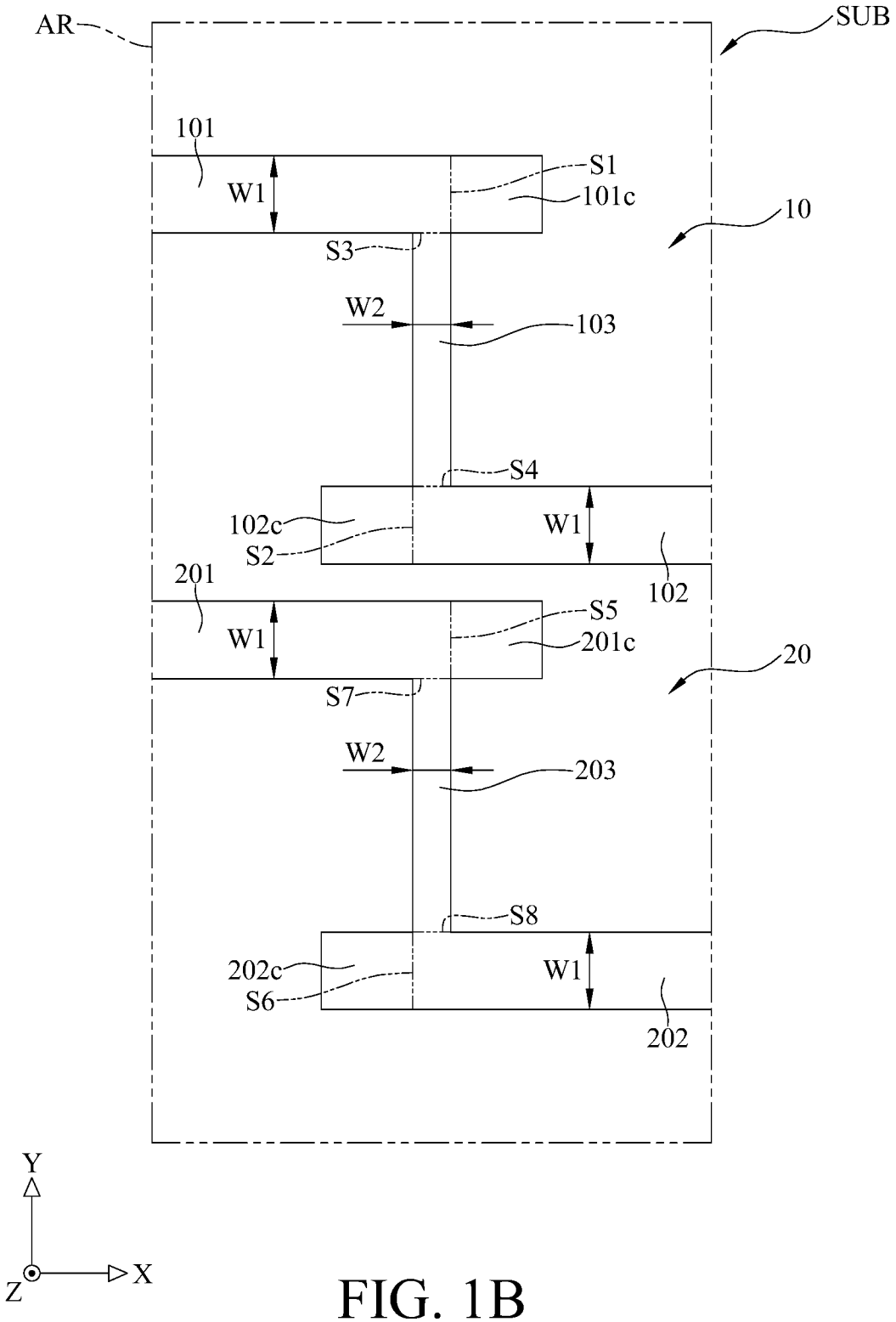
FIG. 1B is a diagram of an enlarged partial area of the transmission line structure according to the embodiment of FIG. 1A.

Please refer to FIG. 1A and FIG. 1B, FIG. 1A is a top view of a transmission line structure according to one embodiment of the present disclosure. FIG. 1B is a diagram of an enlarged form of a partial area in the transmission line structure according to the embodiment of FIG. 1A. FIG. 1B corresponds to the partial area AR as shown in FIG. 1A. As shown in FIG. 1A, the transmission line structure 1 includes a first transmission line 10 and a second transmission line 20 parallel to each other. In practice, the transmission line structure 1 further includes a substrate SUB. The first transmission line 10 and the second transmission line 20 are disposed in the substrate SUB. In practice, the substrate SUB may have a multi-layer structure including a signal transmission layer, several grounding layers and dielectric layers. The detailed description regarding the substrate SUB will be introduced in the following paragraphs, and so is not repeated here. The reference labels (X, Y, Z) shown in FIG. 1A and FIG. 1B stand for X-axis, Y-axis and Z-axis.

Please refer to FIG. 1B, the first transmission line 10 disposed in the substrate SUB includes a first extending segment 101*c*, a first line segment 101, a second extending segment 102*c*, a second line segment 102 and a third line segment 103 as shown in the enlarged form of the partial area AR. The first extending segment 101*c*, the first line segment 101, the second extending segment 102*c* and the second line segment 102 all extend in a first direction (X-axis direction) while the third line segment 103 extends in a second direction (Y-axis direction) perpendicular to the first direction. An end S1 of the first line segment 101 is electrically connected to the first extending segment 101*c*, and an end S2 of the second line segment 102 is electrically connected to the second extending segment 102*c*. The third line segment 103 is electrically connected to a side S3 of the first line segment 101 and a side S4 of the second line segment 102. In this embodiment, the end S1 of the first line segment 101 is adjacent to the side S3 of the first line segment 101, and the end S2 of the second line segment 102 is adjacent to the side S4 of the second line segment 102.

Similar to the first transmission line 10, the second transmission line 20 of the transmission line structure 1 as shown in FIG. 1A, in the present disclosure includes a third extending segment 201*c*, a fourth line segment 201, a fourth extending segment 202*c*, fifth line segment 202 and a sixth line segment 203. The third extending segment 201*c*, the fourth line segment 201, the fourth extending segment 202*c* and the fifth line segment 202 all extend in the first direction while the sixth line segment 203 extends in the second direction. An end S5 of the fourth line segment 201 is electrically connected to the third extending segment 201*c*, and an end S6 of the fifth line segment 202 is electrically connected to the fourth extending segment 202*c*. The sixth line segment 203 is electrically connected to a side S7 of the fourth line segment 201 and a side S8 of the fifth line segment 202. In this embodiment, the end S5 of the fourth line segment 201 is adjacent to the side S7 of the fourth line segment 201, and the end S6 of the fifth line segment 202 is adjacent to the side S8 of the fifth line segment 202. Third line segment 103 is aligned with the sixth line segment 203 in the second direction.

In practice, when signals are transmitted via the parallel transmission lines, far-end crosstalk noise occurs at the receiving terminals of the parallel transmission lines which receives digital signals. As a result, the signal integrity would be negatively affected. The conventional serpentine transmission line structure may be adapted to suppress the far-end crosstalk noise. However, the suppression for the far-end crosstalk noise, provided by the conventional serpentine transmission line structure, is not enough. By taking the advantage of the serpentine transmission line structure with the extending segments disclosed in the present disclosure, the capacitance coupling between the two transmission lines can be increased so as to enhance the suppression for far-end crosstalk noise. Thereby, the interference of far-end crosstalk noise could be reduced significantly.

In one embodiment as shown in FIG. 1B, the first line segment 101, the second line segment 102, the fourth line segment 201 and the fifth line segment 202 all have a first linewidth W1 while the third line segment 103 and the sixth line segment 203 both have a second linewidth W2. The first linewidth W1 is greater than the second linewidth W2. In a practical example, the second linewidth W2 is half of the first linewidth W1. For example, the first linewidth W1 is approximately 6.75 mils while the second linewidth W2 is approximately 3 mils. In an implementation, bending portions and extending segments of the serpentine transmission line structure would result in decreasing impedances and accordingly the problem of unmatched impedances would be raised. To address this problem, in the transmission line structure 1 disclosed in the present disclosure, the width of each of the line segments extending in the vertical direction (Y-axis direction) is less than the width of each of the line segments extending in the horizontal direction (X-axis direction). This configuration of the transmission line structure 1 capable of compensating the decreasing impedance so as to achieve the matched impedances of the transmission lines.

Figure 2:
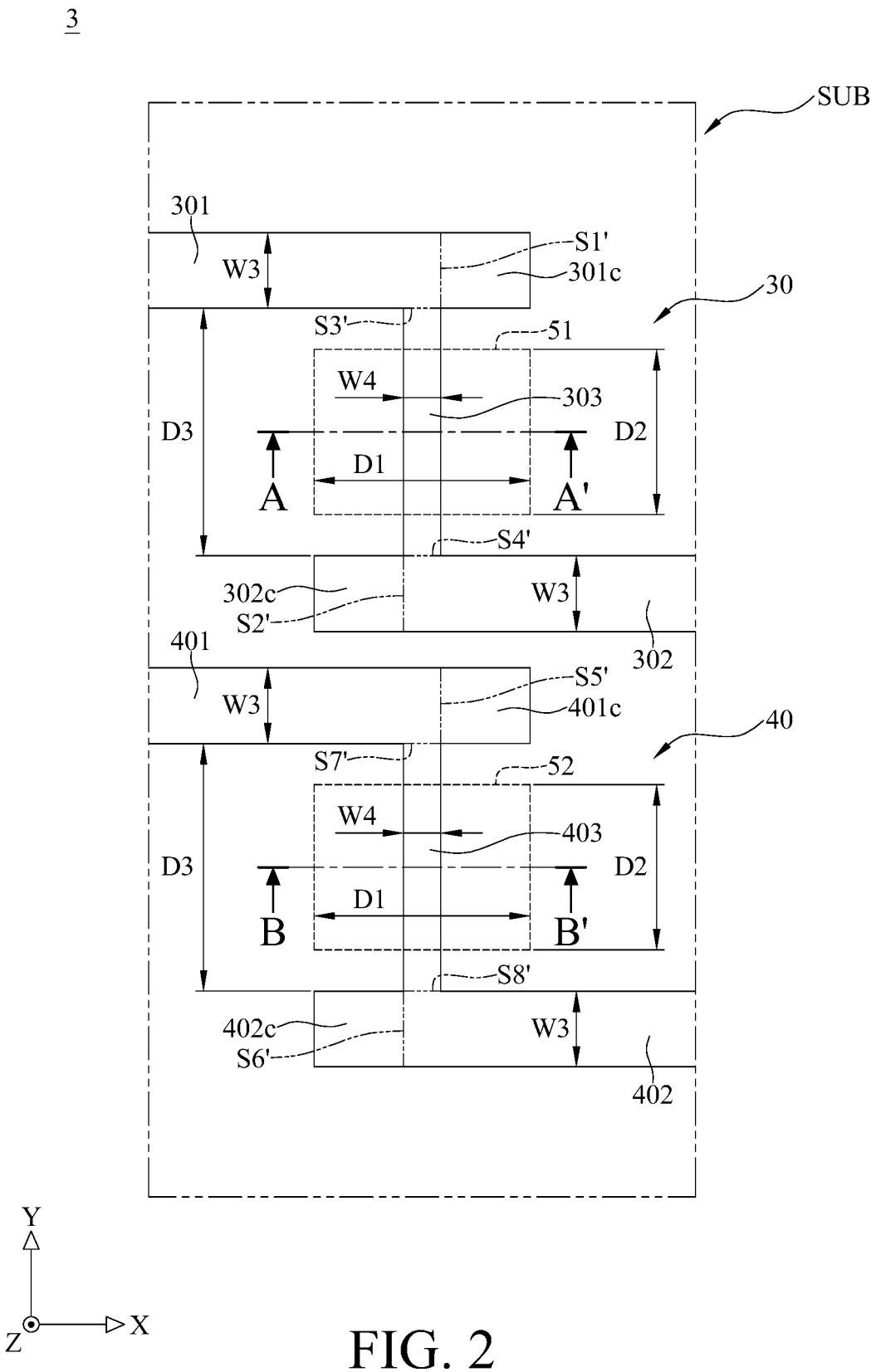
FIG. 2 is a diagram of an enlarged partial area of a transmission line structure according to another embodiment of the present disclosure.

Please refer to FIG. 2, which is a diagram of an enlarged partial area of a transmission line structure according to another embodiment of the present disclosure. The reference labels (X, Y, Z) shown in FIG. 2 stand for X-axis, Y-axis and Z-axis. In FIG. 2, a transmission line structure 3 has a first transmission line 30 and a second transmission line 40 both disposed in the substrate SUB. The first transmission line 30 includes a first extending segment 301*c*, a first line segment 301, a second extending segment 302*c*, a second line segment 302 and a third line segment 303. The second transmission line 40 includes a third extending segment 401*c*, a fourth line segment 401, a fourth extending segment 402*c*, a fifth line segment 402 and a sixth line segment 403. The first line segment 301 has a linewidth W3 an end S1' and a side S3' adjacent to each other, and the second line segment 302 has a linewidth W3 an end S2' and a side S4' adjacent to each other. The fourth line segment 401 has a linewidth W3 an end S5' and a side S7' adjacent to each other, and the fifth line segment 402 has a linewidth W3 an end S6' and a side S8' adjacent to each other. The first transmission line 30 and the second transmission line 40 of the transmission line structure 3 is basically same as the first transmission line 10 and the second transmission line 20 of the transmission line structure 1 shown in FIG. 1, so the same structure is not repeated. The difference between the transmission line structure 3 of FIG. 2 and the transmission line structure 1 of FIG. 1 lies in that the transmission line structure 3 of FIG. 2 further includes a first opening area 51 corresponding to the third line segment 303 and a second opening area 52 corresponding to the sixth line segment 403. The detailed descriptions regarding the first opening area 51 and the second opening area 52 will be introduced in the following paragraphs.

Figure 3A:
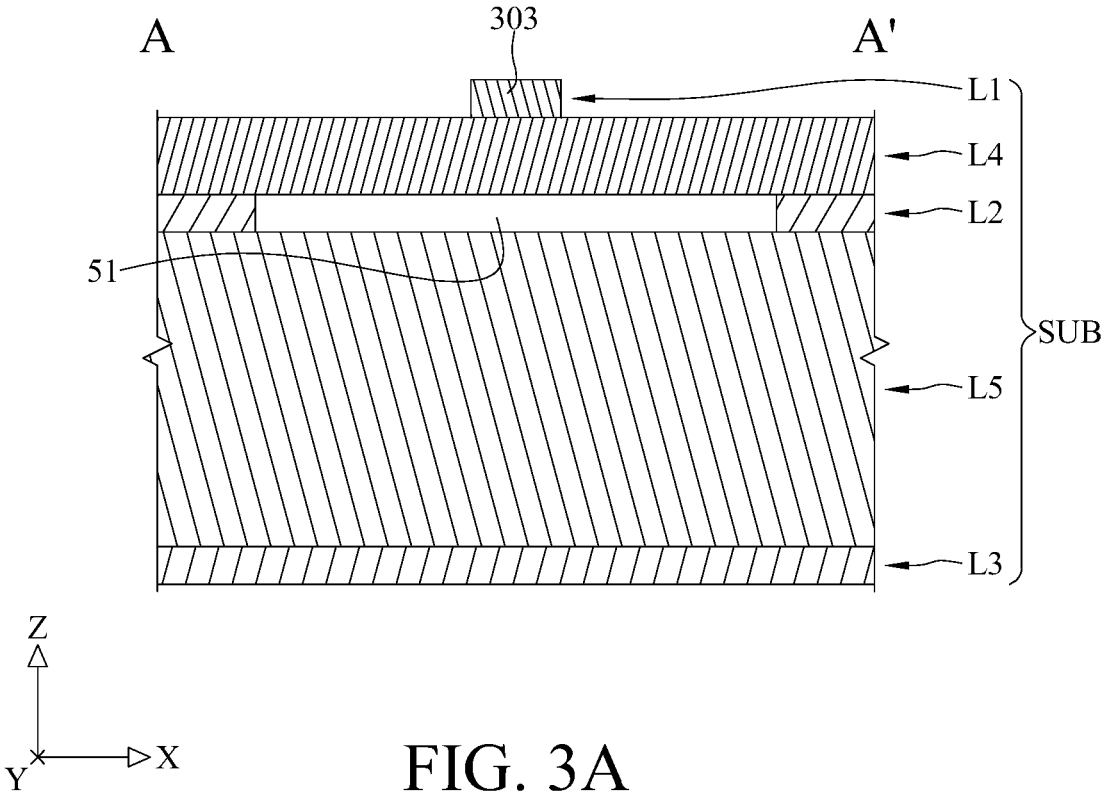
FIG. 3A and FIG. 3B are sectional views of the transmission line structure according to the embodiment of FIG. 2 along sectional lines AA' and BB' respectively.
Figure 3B:
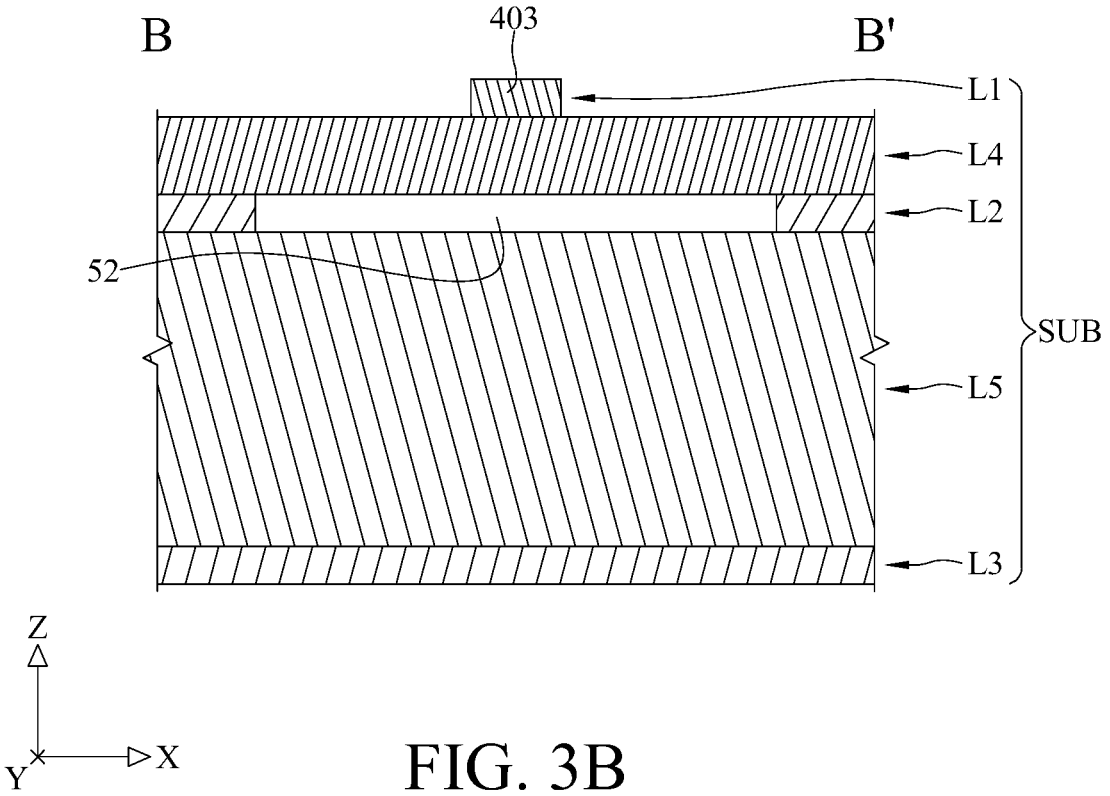

Please refer to FIG. 3A and FIG. 3B, which are sectional views of the transmission line structure 3 according to the embodiment of FIG. 2 along sectional lines AA' and BB' respectively. The reference labels (X, Y, Z) shown in FIG. 3A and FIG. 3B stand for X-axis, Y-axis and Z-axis. As shown in the sectional views of FIG. 3A and FIG. 3B, the substrate SUB of the transmission line structure 3 disclosed in the present disclosure includes a signal transmission layer L1, a first grounding layer L2, a second grounding layer L3, a first dielectric layer L4 and a second dielectric layer L5. Specifically, the signal transmission layer L1, the first grounding layer L2, the second grounding layer L3 are all conductive metal layers while the first dielectric layer L4 and the second dielectric layer L5 are both non-conductive dielectric layers. In other words, the substrate SUB is a multi-layer structure consisting of three metal layers and two dielectric layers. In this embodiment, the signal transmission layer L1 includes the first transmission line 30 and the second transmission line 40 as shown in the embodiment of FIG. 2. The first grounding layer L2 is located below the signal transmission layer L1 and includes the first opening area 51 and the second opening area 52 as shown in the embodiment of FIG. 2. The second grounding layer L3 is located below the first grounding layer L2. The first dielectric layer L4 is located between the signal transmission layer L1 and the first grounding layer L2 while the second dielectric layer L5 is located between the first grounding layer L2 and the second grounding layer L3.

In the sectional view of FIG. 3A, the third line segment 303 overlaps with the first opening area 51 in a third direction (Z-axis direction). In the sectional view of FIG. 3B, the sixth line 403 overlaps with the second opening area 52 in the third direction. In the transmission line structure 3 shown in the embodiments of FIG. 2 and FIG. 3A/3B, the metal layers corresponding to the vertical line segments 303 and 403 are replaced with the opening areas serving as dielectric layers, so that the impedances are further raised for enhancing compensation of the impedances. As a result, the matching of the impedances is further increased.

In one embodiment, both of the first opening area 51 and the second opening area 52 in FIG. 2 have a width D1 along the first direction, and the width D1 is greater than a linewidth W4 of the third line segment 303 and the sixth line segment 403. In one embodiment, the linewidth W4 of the third line segment 303 and the sixth line segment 403 is one-sixth of the width D1 of the first opening area 51 and the second opening area 52. For example, the linewidth W4 of the third line segment 303 and the sixth line segment 403 is 3 mils while the width D1 of the first opening area 51 and the second opening area 52 is 18 mils.

In one embodiment as shown in FIG. 2, the first opening area 51 and the second opening area 52 both has a width D2 in the second direction, and the width D2 is less than the spacing D3 between the first line segment 301 and the second line segment 302 and the spacing D3 between the fourth line segment 401 and the fifth line segment 402. In a practical example, the spacing D3 between the first line segment 301 and the second line segment 302 as well as the spacing between the fourth line segment 401 and the fifth line segment 402 are both 20.25 mils while the width D2 of the first opening area 51 and the second opening area 52 is 14.25 mils.

The sizes of the opening areas in the above embodiments are merely for illustration. In practice, the sizes of the opening areas could be adjusted according to actual demands, and the present disclosure is not limited to the above embodiments. In one embodiment, the first opening area 51 and the second opening area 52 may be gaps filled with dielectric materials. However, in another embodiment, the first opening area 51 and the second opening area 52 may be air gaps.

Figure 4A:
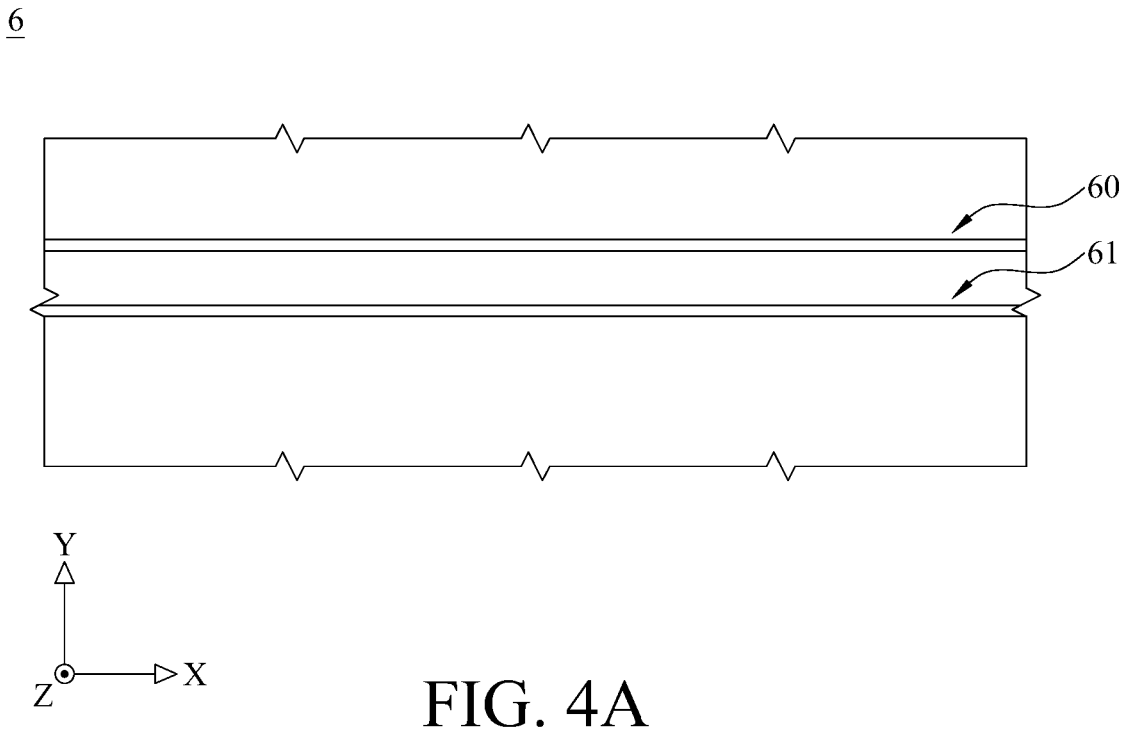
FIG. 4A (PRIOR ART)
FIG. 4A is a top view of a traditional transmission line structure.
Figure 4B:
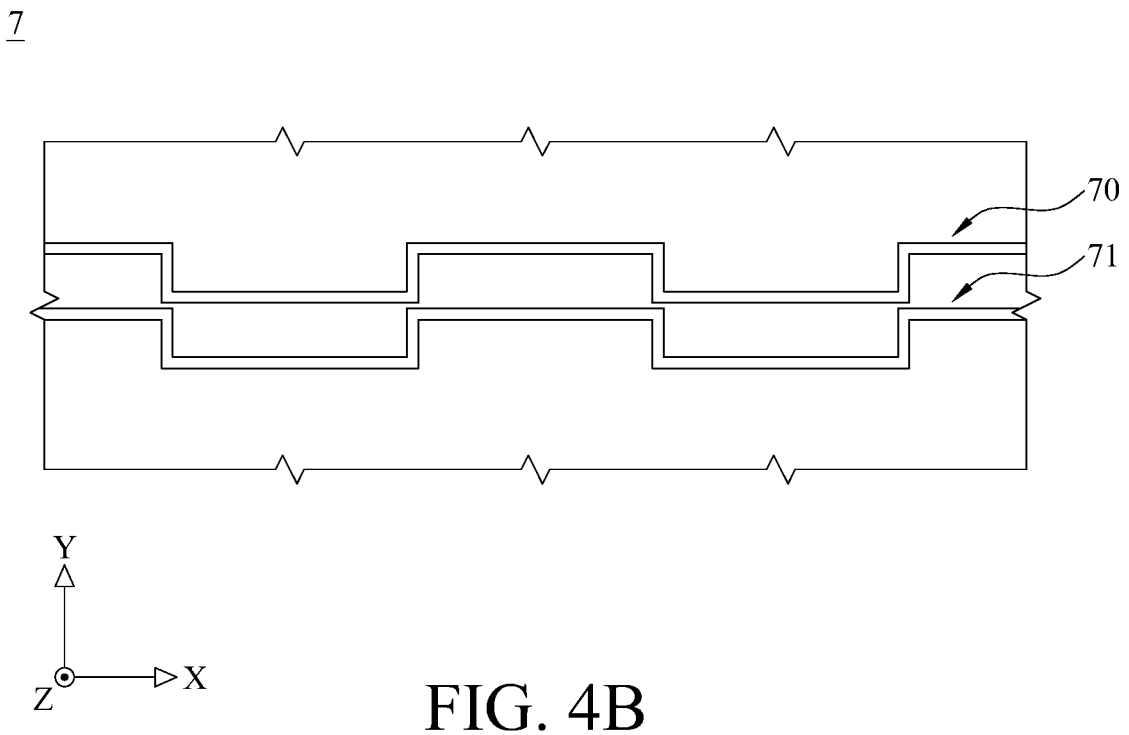
FIG. 4B (PRIOR ART)
FIG. 4B is a top view of a conventional improved transmission line structure.

Please refer to FIG. 4A and FIG. 4B, which are top views of a traditional transmission line structure and a conventional improved transmission line structure. The reference labels (X, Y, Z) shown in FIG. 4A and FIG. 4B stand for X-axis, Y-axis and Z-axis. The transmission line structure 6 of FIG. 4A includes two linear transmission lines 60 and 61 parallel to each other, wherein the two linear transmission lines 60 and 61 have the same linewidths. The transmission line structure 7 of FIG. 4B includes two serpentine transmission lines 70 and 71 parallel to each other, wherein the two serpentine transmission lines 70 and 71 have the same linewidths. Comparisons of far-end crosstalk noise for the transmission line structure disclosed in the present disclosure and the transmission line structures shown in FIG. 4A and FIG. 4B will be introduced in the following paragraphs.

Figure 5:
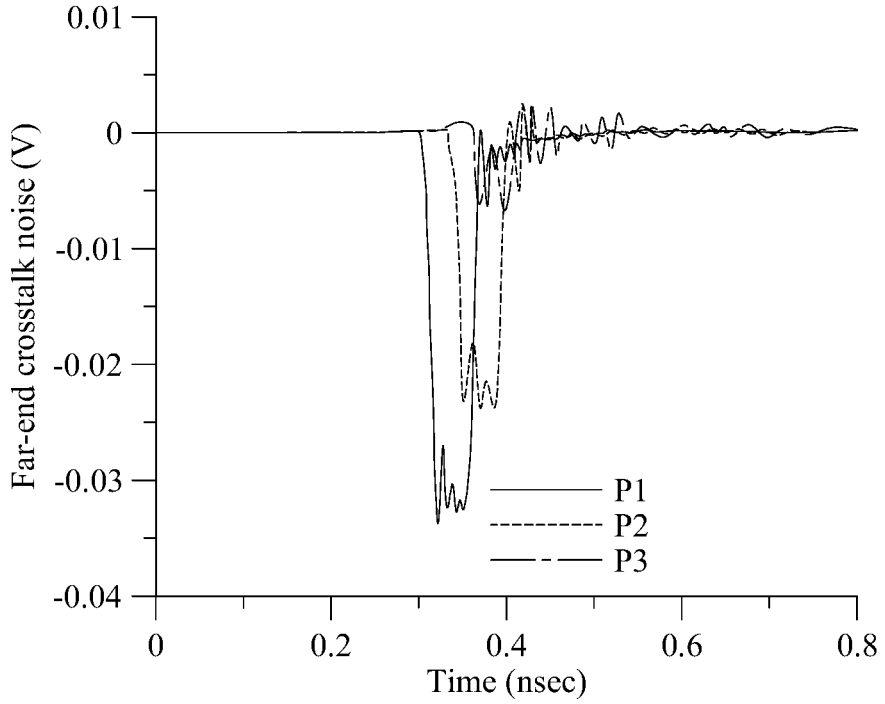
FIG. 5 is a waveform of far-end crosstalk according to one embodiment of the present disclosure.

Please further refer to FIG. 5, which is a waveform of far-end crosstalk according to one embodiment of the present disclosure. In FIG. 5, the horizontal axis is labeled as time (n sec) while the vertical axis is labeled as far-end crosstalk noise (Volt). In FIG. 5, the curve P1 represents the changes of far-end noise for the transmission line structure 6 in FIG. 4A, the curve P2 represents the changes of far-end noise for the transmission line structure 7 in FIG. 4B, and the curve P3 represents the changes of far-end noise for the transmission line structure of the present disclosure. According to FIG. 5, the suppression ratio for far-end noise, provided by the conventional transmission line structure 7, is around 30% while the suppression ratio for far-end cross talk noise, provided by the transmission line structure of the present disclosure, is around 70%. In other words, the suppression for far-end noise, provided by the serpentine transmission line structure with the extending segments shown in the transmission line structure disclosed by the present disclosure, is better than the suppression for far-end noise, provided by the conventional improved transmission line structure 7.

Figure 6:
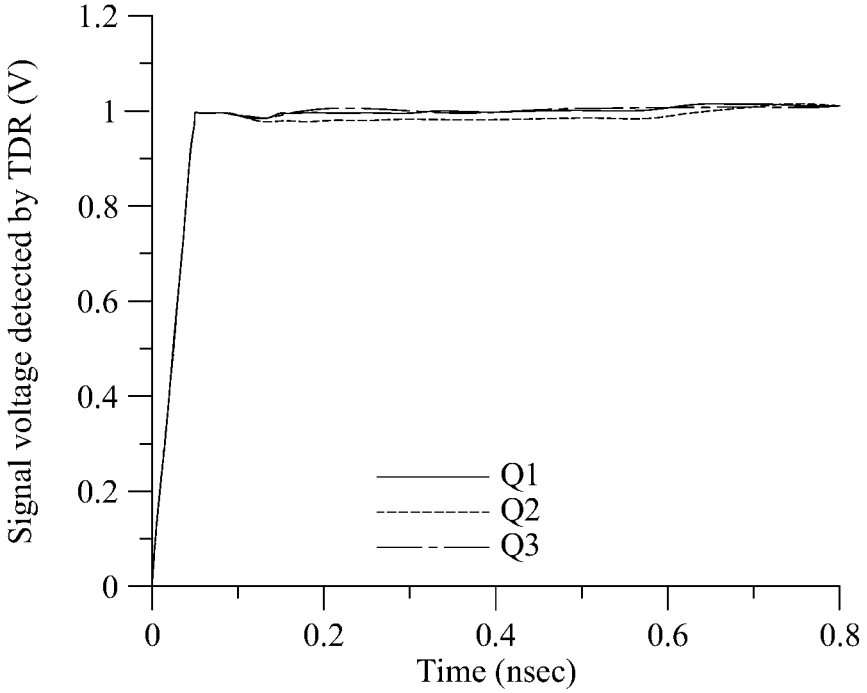
FIG. 6 is a waveform of detections by a time domain reflectometer according to one embodiment of the present disclosure.

Please refer to FIG. 6, which is a waveform of detections by a time domain reflectometer according to one embodiment of the present disclosure. In FIG. 6, the horizontal axis is labeled as time (n sec) while the vertical axis is labeled as a signal voltage (Volt) of the time domain reflectometer (TDR) for indicating the reflection of the signal transmitted in the transmission line. The time domain reflectometer (TDR) is a technique for determining characteristic impedances of a transmission line by detecting the reflection of the signal transmitted in the transmission line. Specifically, the curves of FIG. 6 reflect the discontinuity of impedances caused by parasitic capacitances in the transmission line. In other words, when impedances of the transmission line become unmatched, the waveform detected by the time domain reflectometer is unstable. When impedances of the transmission line become matched, the waveform detected by the time domain reflectometer is stable.

In FIG. 6, the curve Q1 represents the time-domain reflection of the transmission line structure 6 in FIG. 4A, the curve Q2 represents the time-domain reflection of the transmission line structure 7 in FIG. 4B, and the curve Q3 represents the time-domain reflection of the transmission line structure of the present disclosure. According to FIG. 6, the impedances of the conventional improved transmission line structure 7 are decreased due to the raise of mutual capacitance. However, in the transmission line structure of the present disclosure, because of the reductions of the linewidths of the vertical third line segment and the vertical sixth line segment as well as configurations of the opening areas (filled with dielectric materials) in the grounding layer corresponding to the vertical line segments, the decreased impedances of the serpentine transmission line, caused by mutual capacity, could be compensated so as to achieve the impedance matching.

Figure 7:
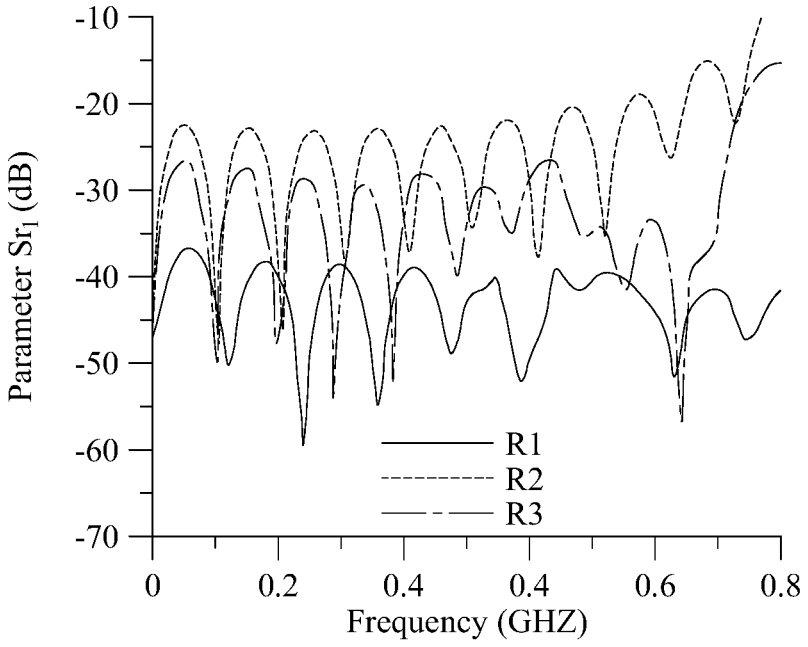
FIG. 7 is a waveform of frequency-domain reflection according to one embodiment of the present disclosure.

Please refer to FIG. 7, which is a waveform of frequency-domain reflection according to one embodiment of the present disclosure. As shown in FIG. 7, the horizontal axis is labeled as "frequency (GHz)" while the vertical axis is labeled as "parameter Sr1 (dB)." The parameter Sr1 in dB of the vertical axis is for indicating the signal reflection of a transmission line, which can be calculated based on the formula:

$$Sr1 = 20\log\frac{|Vr|}{|V1|},$$

wherein voltage V1 represents an input signal voltage of the transmission line, and the voltage Vr represents the signal voltage which is reflected in the transmission line. In general, during the process of signal transmission, the weaker the signal reflection is, the more significantly the impedances could be matched. On the contrast, the stronger the signal reflection is, the more significantly the impedances could be unmatched. In other words, the closer the curve could be to the top of FIG. 7, the more significantly the impedances could be unmatched. In FIG. 7, the curve R1 represents the signal reflection of the transmission line structure 6 in FIG. 4A, the curve R2 represents the signal reflection of the transmission line structure 7 in FIG. 4B, and the curve R3 represents the signal reflection of the transmission line structure disclosed in the present disclosure. According to the curves shown in FIG. 7, the signal reflection of the transmission line structure disclosed in the present disclosure is lower than the signal reflection of the conventional improved transmission line structure 7. In other words, FIG. 7 proves that the matching of impedances of the transmission line structure disclosed in the present disclosure is higher than the matching of impedances of the conventional improved transmission line structure.

Based on the above descriptions, in the transmission line structure of the present disclosure, an extending segment is connected to an end of a line segment in a bending portion of the transmission lines so as to enhance the capacitance coupling between the two transmission lines for reducing the interference of far-end crosstalk noise. As a result, the integrity of signal can be achieved. Moreover, by taking the advantage of the configuration in which the linewidths of the vertical line segments are smaller than the linewidths of the horizontal line segments in the transmission line structure and the dielectric opening areas of the grounding layer are disposed corresponding to the vertical line segments, the decreases of impedances caused by the bending portions and the extending segments can be compensated accordingly.

What is claimed is:

1. A transmission line structure, comprising:

a first transmission line, comprising:

a first extending segment extending in a first direction;

a first line segment extending in the first direction, with an end of the first line segment electrically connected to the first extending segment;

a second extending segment extending in the first direction;

a second line segment extending in the first direction, with an end of the second line segment electrically connected to the second extending segment; and a third line segment extending in a second direction perpendicular to the first direction and electrically connected to a side of the first line segment and a side of the second line segment; and a second transmission line parallel to the first transmission line, comprising:

a third extending segment extending in the first direction;

a fourth line segment extending in the first direction, with an end of the fourth line segment electrically connected to the third extending segment;

a fourth extending segment extending in the first direction;

a fifth line segment extending in the first direction, with an end of the fifth line segment electrically connected to the fourth extending segment; and a sixth line segment extending in the second direction and electrically connected to a side of the fourth line segment and a side of the fifth line segment;

wherein the third line segment is aligned with the sixth line segment in the second direction, the end of the first line segment is adjacent to the side of the first line segment, the end of the second line segment is adjacent to the side of the second line segment, the end of the fourth line segment is adjacent to the side of the fourth line segment, and the end of the fifth line segment is adjacent to the side of the fifth line segment.

2. The transmission line structure according to claim 1, wherein a signal transmission layer comprises the first transmission line and the second transmission line, with the transmission line structure further comprising:

a first grounding layer below the signal transmission layer and comprising a first opening area and a second opening area;

a second grounding layer below the first grounding layer;

a first dielectric layer located between the signal transmission layer and the first grounding layer; and a second dielectric layer located between the first grounding layer and the second grounding layer;

wherein the third line segment overlaps with the first opening area in a third direction, and the sixth line overlaps with the second opening area in the third direction.

3. The transmission line structure according to claim 2, wherein both of the first opening area and the second opening area have a width along the first direction, and the width is greater than a linewidth of the third line segment and a linewidth of the sixth line segment.

4. The transmission line structure according to claim 3, wherein both of the linewidth of the third line segment and the linewidth of the sixth line segment are one-sixth of the width.

5. The transmission line structure according to claim 2, wherein both of the first opening area and the second opening area has a width along the second direction, and the width is less than a spacing between the first line segment and the second line segment and a spacing between the fourth line segment and the fifth line segment.

6. The transmission line structure according to claim 2, wherein both of the first opening area and the second opening area comprise dielectric materials.

7. The transmission line structure according to claim 1, wherein all of the first line segment, the second line segment, the fourth line segment and the fifth line segment have a first linewidth, both of the third line segment and the sixth line segment have a second linewidth, and the first linewidth is greater than the second linewidth.

8. The transmission line structure according to claim 7, wherein the second linewidth is a half of the first linewidth.

* * * * *